US007111363B2

(12) United States Patent
Lee et al.

(10) Patent No.: US 7,111,363 B2
(45) Date of Patent: Sep. 26, 2006

(54) DOOR HINGE STRUCTURE FOR REFRIGERATOR

(75) Inventors: Seung-Ryong Lee, Incheon (KR); Sang-Jin Lee, Incheon (KR)

(73) Assignee: Lotte Engineering & Machinery Mfg., Co., Ltd., (KR)

( * ) Notice: Subject to any disclaimer, the term of this patent is extended or adjusted under 35 U.S.C. 154(b) by 130 days.

(21) Appl. No.: 10/903,431

(22) Filed: Jul. 30, 2004

(65) Prior Publication Data

US 2005/0188506 A1 Sep. 1, 2005

(30) Foreign Application Priority Data

Feb. 26, 2004 (KR) ..... 10-2004-0013036
Feb. 27, 2004 (KR) ..... 20-2004-0005279

(51) Int. Cl.
*E05D 11/06* (2006.01)

(52) U.S. Cl. ..... 16/376; 16/330; 16/334; 16/295

(58) Field of Classification Search ..... 16/376, 16/374, 377, 327, 330, 334, 280–281, 295, 16/298–301, 307–308; 312/405, 326, 329; 49/382, 381, 388, 236
See application file for complete search history.

(56) References Cited

U.S. PATENT DOCUMENTS 165,619 A * 7/1875 Sanderson ..... 16/318
1,332,881 A * 3/1920 Bommer ..... 16/279
1,573,550 A * 2/1926 Keene ..... 16/241
2,626,421 A * 1/1953 Lyons ..... 16/300
3,339,225 A * 9/1967 Booth ..... 16/300
3,378,881 A * 4/1968 Hentzi et al. ..... 16/312
3,510,986 A 5/1970 Berkowitz
3,518,716 A * 7/1970 Larson ..... 16/284
3,546,736 A * 12/1970 Booth ..... 16/312
3,628,845 A * 12/1971 Grimm ..... 312/309
3,683,453 A * 8/1972 McLeland et al. ..... 16/248
4,070,728 A * 1/1978 Herman ..... 16/243
4,090,274 A * 5/1978 Bourgeois ..... 16/317
4,215,449 A * 8/1980 Loikitz ..... 16/50
5,138,743 A * 8/1992 Hoffman ..... 16/303

(Continued)

FOREIGN PATENT DOCUMENTS

DE 3709331 A1 * 9/1988

(Continued)

*Primary Examiner*—Chuck Y. Mah
(74) *Attorney, Agent, or Firm*—Cantor Colburn LLP

(57) ABSTRACT

Disclosed herein is a door hinge structure for a refrigerator. The door hinge structure comprises an upper fixture unit which is screwed to a predetermined front upper portion of a refrigerator body, and has an upper hinge pin to be inserted in a top aperture formed at an upper surface of a refrigerator door, an upper hinge unit which is mounted on the upper surface of the door, and has a through opening for allowing a distal end of the upper hinge pin to be slidably inserted therethrough, the upper hinge unit being coupled with the upper fixture unit by making use of a torsion spring so that it is vertically spaced therewith, a lower fixture unit which is screwed to a predetermined front lower portion of the body, and has a lower hinge pin to be inserted in a bottom aperture formed, at a lower surface of the door, a lower hinge unit which is mounted on the lower surface of the door, and has a through opening for the insertion of the lower hinge pin, and a stopper member which is interposed between the lower fixture unit and the lower hinge unit and is adapted to stop pivotal movement of the door at least one time.

13 Claims, 10 Drawing Sheets

U.S. PATENT DOCUMENTS 5,158,503 A * 10/1992 Mitchell ..... 16/278
5,369,842 A * 12/1994 Beatty ..... 16/317
5,682,644 A * 11/1997 Bohacik et al. ..... 16/284

FOREIGN PATENT DOCUMENTS

EP 564705 A2 * 10/1993
GB 2281099 A * 2/1995
JP 11248341 A * 9/1999
JP 2002030856 A * 1/2002

* cited by examiner

DOOR HINGE STRUCTURE FOR REFRIGERATOR

BACKGROUND OF THE INVENTION

1. Field of the Invention

The present invention relates to a door hinge structure for a refrigerator, and more particularly to a simplified door hinge structure for a refrigerator which is capable of smoothly keeping a refrigerator door open when food is placed into or taken out of the interior of the refrigerator, thereby enhancing convenience in use of the refrigerator.

2. Description of the Related Art

In general, refrigerators include a door pivotably coupled to a front side of their body by means of a door hinge. In an open state of the door, the door hinge allows the door to be automatically closed to the body.

Representative prior art of a door hinge structure is disclosed in U.S. Pat. No. 3,510,986. The configuration and operation of the disclosed door hinge structure will now be explained with reference to FIG. 10.

FIG. 10 is a longitudinal sectional view illustrating an important portion of a door hinge structure of the prior art.

As shown in FIG. 10, the door hinge structure for a refrigerator of the prior art comprises: an upper bracket 100 attached to a body 1 of the refrigerator above a refrigerator door 2; and an upper mount 200 in contact with an upper surface of the refrigerator door 2. The upper bracket 100 has a hinge pin 101, and a support shaft 102 attached to a lower surface of the hinge pin 101. The upper mount 200 has a spring housing 202, and a torsion spring 201 disposed within the spring housing 202. In such a state, the hinge pin 101 and the support shaft 102 are inserted in the spring housing 202. The upper mount 200 is assembled with the upper bracket 100 by means of the torsion spring 201.

The above described door hinge structure further comprises: a lower bracket 300 attached to the body 1 below the door 2, through which a lower hinge pin 301 is fastened; a lower mount 400 in contact with a lower surface of the door 2; and a slidable member 500 interposed between the lower bracket 300 and the lower mount 400. Fixed on the lower mount 400 is an insert member 401, which is fitted through the lower surface of the door 2 in a state wherein the lower hinge pin 301 is inserted therein.

With such a door hinge structure of the prior art as stated above, if the door 2 is swung open, the torsion spring 201 will be distorted and tensioned, thereby allowing the door 2 to be automatically closed.

Such a configuration wherein the torsion spring causes the door to move from an open position and to close itself, however, has a problem in that it is impossible to keep the door open for a long time.

Since the door cannot be retained in the open position, and is automatically closed, users suffer inconvenience whenever they place food into or taken it out of the interior of the refrigerator body.

Further, the door hinge structure of the prior art is very complex, and thus is troublesome in manufacturing and installation thereof.

SUMMARY OF THE INVENTION

Therefore, the present invention has been made in view of the above problems, and it is an object of the present invention to provide a simplified door hinge structure for a refrigerator which can smoothly keep a refrigerator door open when food is placed into or taken out of the interior of the refrigerator, thereby enhancing convenience in use of the refrigerator.

It is another object of the present invention to provide a simplified door hinge structure for a refrigerator which can secure easy installation thereof.

It is yet another object of the present invention to provide a door hinge structure for a refrigerator which can allow a door to move from the open position and to close itself easily even by a gentle push thereon.

In accordance with the present invention, the above and other objects can be accomplished by the provision of a door hinge structure for a refrigerator comprising: an upper fixture unit screwed to a predetermined front upper portion of a refrigerator body, and having an upper hinge pin to be inserted in a top aperture formed at an upper surface of a refrigerator door; an upper hinge unit mounted on the upper surface of the door, and having a through opening for allowing a distal end of the upper hinge pin to be slidably inserted therethrough, the upper hinge unit being coupled with the upper fixture unit by making use of a torsion spring so that it is vertically spaced therewith; a lower fixture unit screwed to a predetermined front lower portion of the body, and having a lower hinge pin to be inserted in a bottom aperture formed at a lower surface of the door; a lower hinge unit mounted on the lower surface of the door, and having a through opening for the insertion of the lower hinge pin; and a stopper member interposed between the lower fixture unit and the lower hinge unit and adapted to stop pivotal movement of the door at least one time.

Preferably, the stopper member may include: a mount mounted on an upper surface of the lower fixture unit, and having a central opening for the insertion of the lower hinge pin; at least two rounded upwardly-raised lower stops circularly aligned on an upper surface of the mount; and at least two rounded downwardly-raised upper stops circularly aligned around the through opening of the lower hinge unit in an engagable manner with the upwardly-raised lower stops.

Preferably, the upper fixture unit may include: an upper bracket screwed to the predetermined front upper portion of the body; an upper arm horizontally extending from a lower end of the upper bracket at right angles thereto; an upper opening perforated in the upper arm for allowing the upper hinge pin to be fixedly inserted therein.

Preferably, the upper hinge unit may include: an upper mount mounted on the upper surface of the door, and having the through-opening; a plate provided at a lower surface of the upper mount so as to surround the through-opening, the plate being insertable in an upper groove formed along an inner periphery of the top aperture; a hollow insertion column attached to a lower surface of the plate to be vertically aligned with the through opening, into which a torsion spring is inserted.

Preferably, the lower fixture unit may include: a lower bracket screwed to the predetermined front lower portion of the body; a lower arm horizontally extending from an upper end of the lower bracket at right angles thereto; and a lower opening perforated in the lower arm for allowing the lower hinge pin to be fixedly inserted therein.

Preferably, the lower hinge unit may include: a lower mount mounted on the lower surface of the door, and having the through opening; and a plate provided at an upper surface of the lower mount to surround the through opening, the plate being insertable in a lower groove formed along an inner periphery of the bottom aperture.

In order to smoothly keep the door open as well as allow the door to move from the open position and to close itself even by a gentle push thereon, each of the upwardly-raised lower stops and the downwardly-raised upper stops may include: a gentle sloped surface formed at one lateral side thereof so as to be inclined in a door opening direction; and a steep sloped surface formed at the other lateral side thereof so as to be inclined in a door closing direction.

Further, in order to achieve easy installation and stable torsional tension of the torsion spring even while securing smooth vertical movement of the door, the upper hinge pin may be formed at a bottom wall thereof with a plurality of insertion holes for allowing an upper end of the torsion spring to be selectively inserted therein, and the hollow insertion column may be formed at a bottom wall thereof with a plurality of insertion holes for allowing a lower end of the torsion spring to be selectively inserted therein. At the center of the bottom wall of the upper hinge pin may be vertically attached a support rod, and from the center of the bottom wall of the hollow insertion column a sliding tube may extend upwardly for enabling slidable insertion of the support rod.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Preferred embodiments related to a door hinge structure for a refrigerator in accordance with the present invention will be explained with reference to the accompanying drawings.

Figure 1:
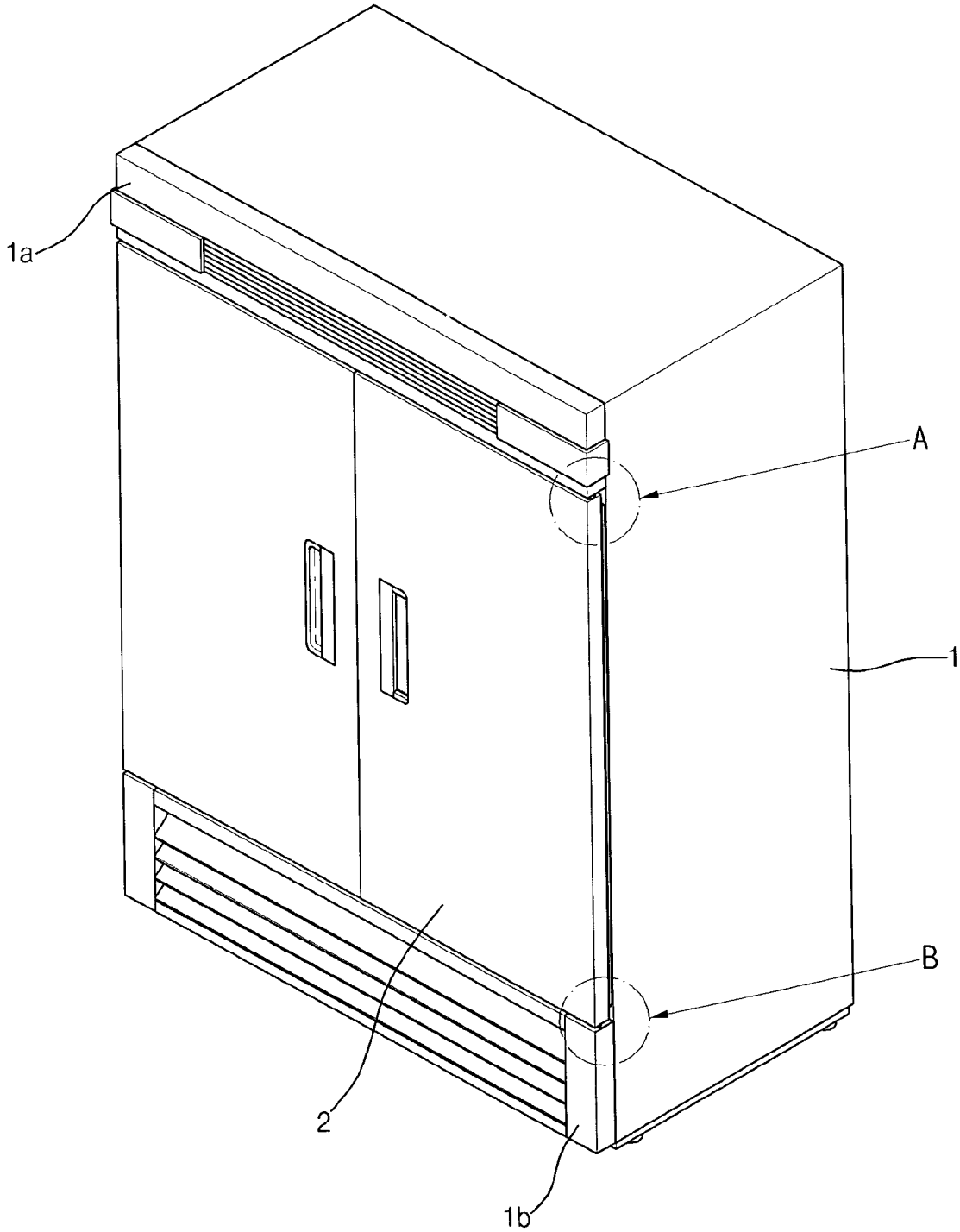
FIG. 1 is a perspective view illustrating a refrigerator of the present invention.

FIG. 1 is a perspective view illustrating a refrigerator of the present invention.

As shown in FIG. 1, the refrigerator comprises a body 1 for storing fresh or chilled food, a pair of doors 2 pivotably coupled to a front side of the body 1 by means of door hinges, and upper and lower covers 1*a* and 1*b* attached to the front side of the body 1 above and below the doors 2, respectively.

Figure 2:
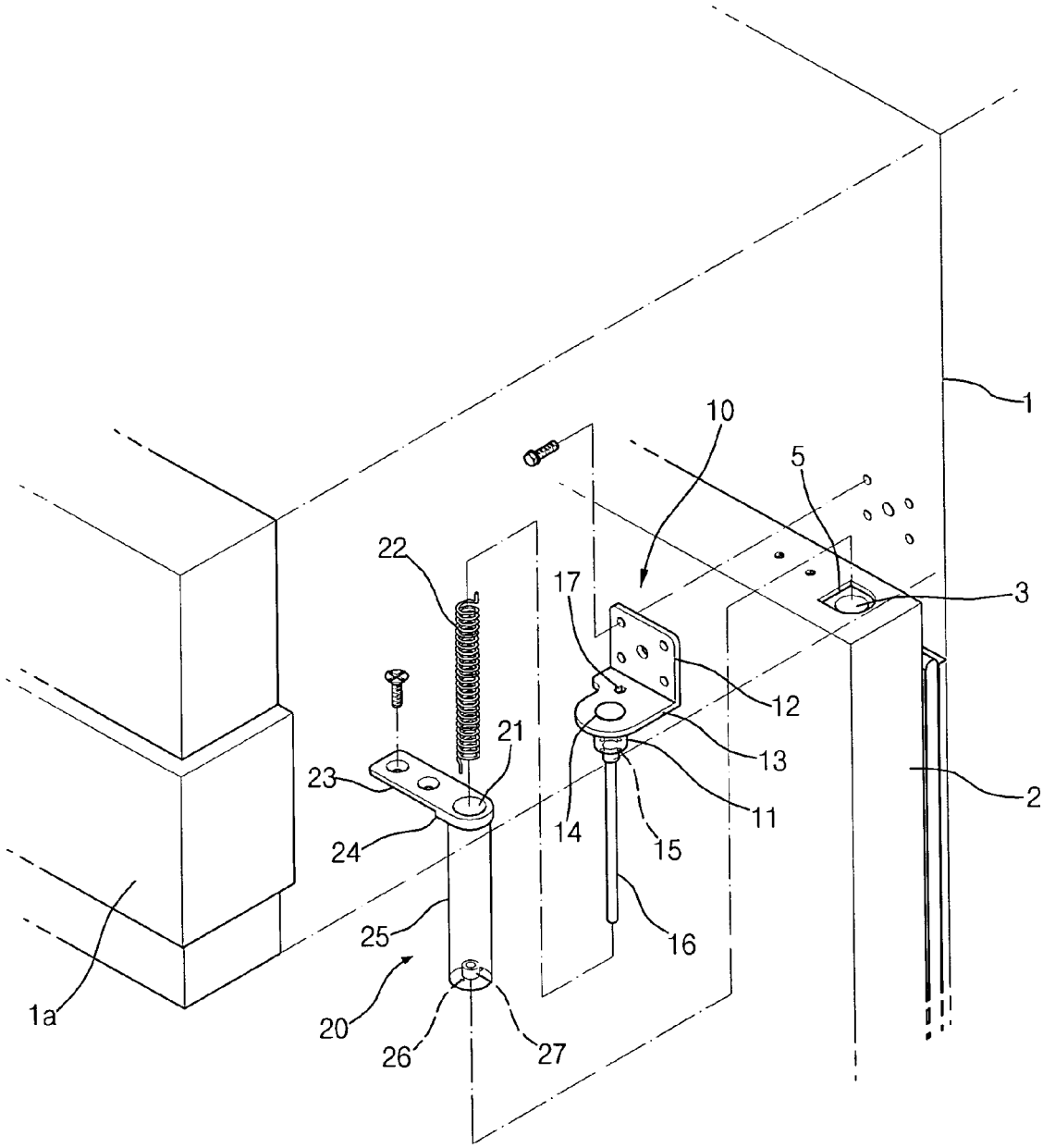
FIG. 2 is an exploded perspective view illustrating a door hinge structure for a refrigerator in accordance with the present invention, in relation to the circle (A) shown in FIG. 1.
Figure 3:
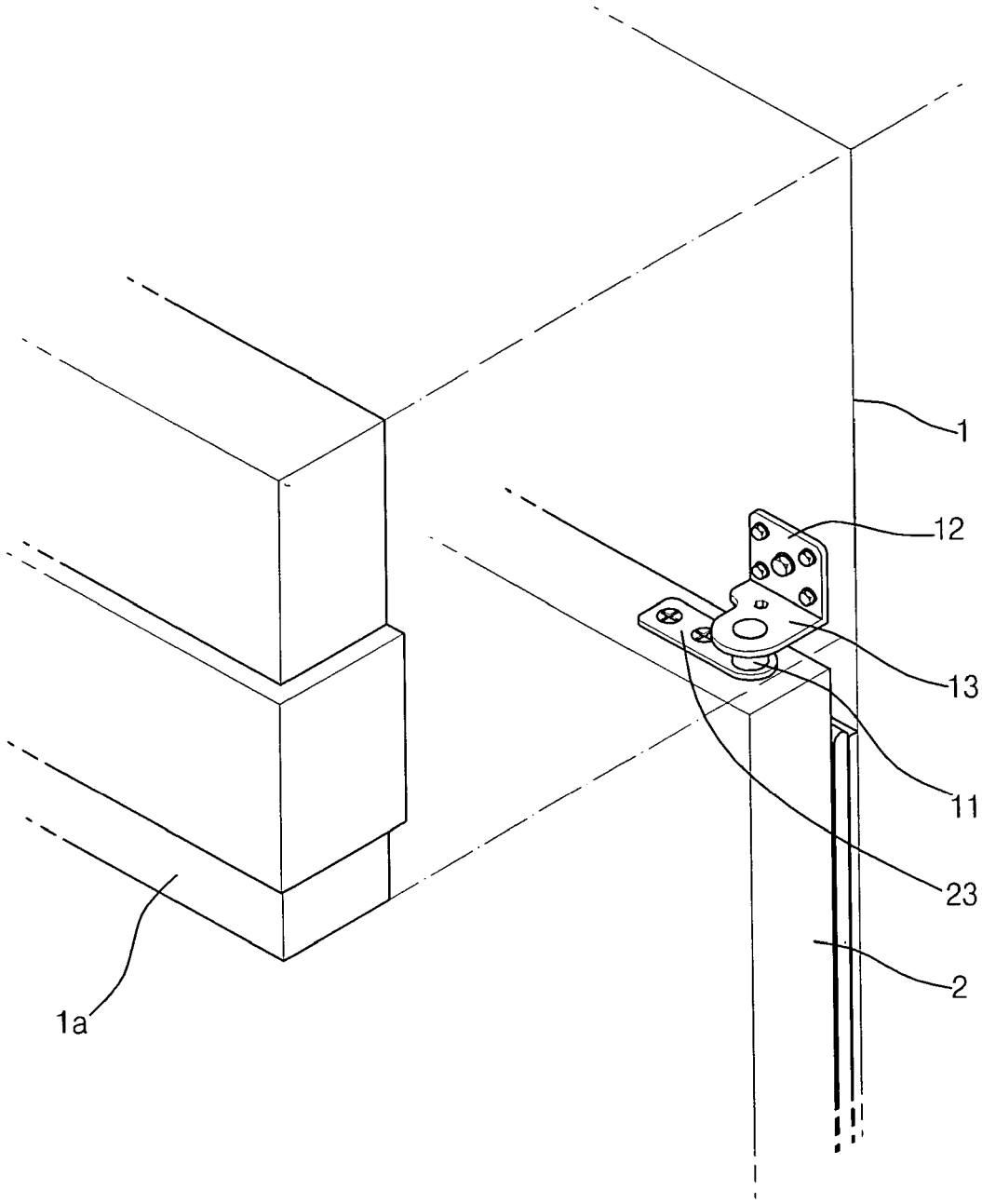
FIG. 3 is a perspective view illustrating an assembled state of the door hinge structure shown in FIG. 2.

FIG. 2 is an exploded perspective view illustrating a door hinge structure for a refrigerator in accordance with the present invention, in relation to the circle (A) shown in FIG. 1. FIG. 3 is a perspective view illustrating an assembled state of the door hinge structure shown in FIG. 2.

As shown in FIGS. 2 and 3, a door hinge structure for a refrigerator comprises: an upper fixture unit 10 screwed to the body 1 behind the upper cover 1*a* at an upper side of either door 2; and an upper hinge unit 20 mounted on an upper surface of the door 2 so that it is hingedly coupled with the upper fixture unit 10.

The upper fixture unit 10, in turn, includes: an upper bracket 12 screwed to the body 1; an upper arm 13 horizontally extending from a lower end of the upper bracket 12 at right angles thereto; an upper opening 14 perforated in the upper arm 13; and an upper hinge pin 11 fixedly inserted at its upper end in the upper opening 14.

The upper hinge pin 11 is formed at a bottom wall thereof with a plurality of insertion holes 15. At the center of the bottom wall of the upper hinge pin 11 is vertically attached a support rod 16.

In the upper fixture unit 10, since the upper bracket 12 thereof is screwed to a predetermined upper position of a front surface of the body 1 and the upper hinge pin 11 thereof is inserted in the upper hinge unit 20, it serves to pivotably fix the upper hinge unit 20 relative to the refrigerator body 1.

The upper hinge unit 20 comprises: an upper mount 23 mounted on the upper surface of the door 2; a through-opening 21 perforated in the upper mount 23 so as to be vertically aligned with a top aperture 3 of the door 2 for the insertion of the upper hinge pin 11; a plate 24 provided at a lower surface of the upper mount 23 so as to surround the through-opening 21; a hollow insertion column 25 attached to a lower surface of the plate 24; and a torsion spring 22 disposed within the hollow insertion column 25 for the elastic coupling of the upper hinge unit 20 and the upper fixture unit 10.

The hollow insertion column 25 is formed at a bottom wall thereof with a plurality of insertion holes 26. From the center of the bottom wall of the hollow insertion column 25 a sliding tube 27 extends upwardly.

In a state wherein the upper mount 23 thereof is screwed to the upper surface of the door 2, and the upper hinge pin 11 of the upper fixture unit 10 is inserted through the through-opening 21 thereof, as the upper hinge unit 20 is elastically coupled to the upper fixture unit 10 by making use of the torsion spring 22, the door 2 is pivotably fixed relative to the body 1 under the effect of torsional tension.

The plate 24 provided at the lower surface of the upper mount 23 is engaged in an upper groove 5 formed along an inner periphery of the top aperture 3 of the door 2. This has an effect of increasing a fixing force of the upper mount 23 even while increasing ease in installation thereof.

Into one of the insertion holes 15 formed at the upper hinge pin 11 and into one of the insertion holes 26 formed at the hollow insertion column 25 are inserted upper and lower ends of the torsion spring 22, respectively. This allows the torsion spring 22 to be smoothly tensioned as the door 2 is swung open.

The support rod 16, attached to the upper hinge pin 11, is inserted in the hollow insertion column 25 and is slidably fitted at a lower end thereof in the sliding tube 27. Such a support rod 16 serves to support the upper hinge pin 11 within the hollow insertion column 25 in a vertically slidable as well as rotatable manner.

The upper hinge pin 11 is inserted at a lower end thereof in the through-opening 21, so that the upper fixture unit 10 is vertically spaced apart from the upper hinge unit 20 by a predetermined distance. As a result, when the door 2 is opened away or closed to the body 1, the door 2 is first raised by the predetermined distance, and then is returned to its original lower position and stopped.

In this case, the rising or lowering of the door 2 is achieved as the through-opening 21 slides upward or downward along the upper hinge pin 11.

Meanwhile, the upper arm 13 is further formed with a hexagonal wrench hole 17 for enabling manual rotation of the upper fixture unit 10 using a hexagonal wrench. Such a wrench hole 17, therefore, allows the upper fixture unit 10 to be fastened to the body 1 in a state wherein the torsional tension of the torsion spring 22 is maximized.

Figure 4:
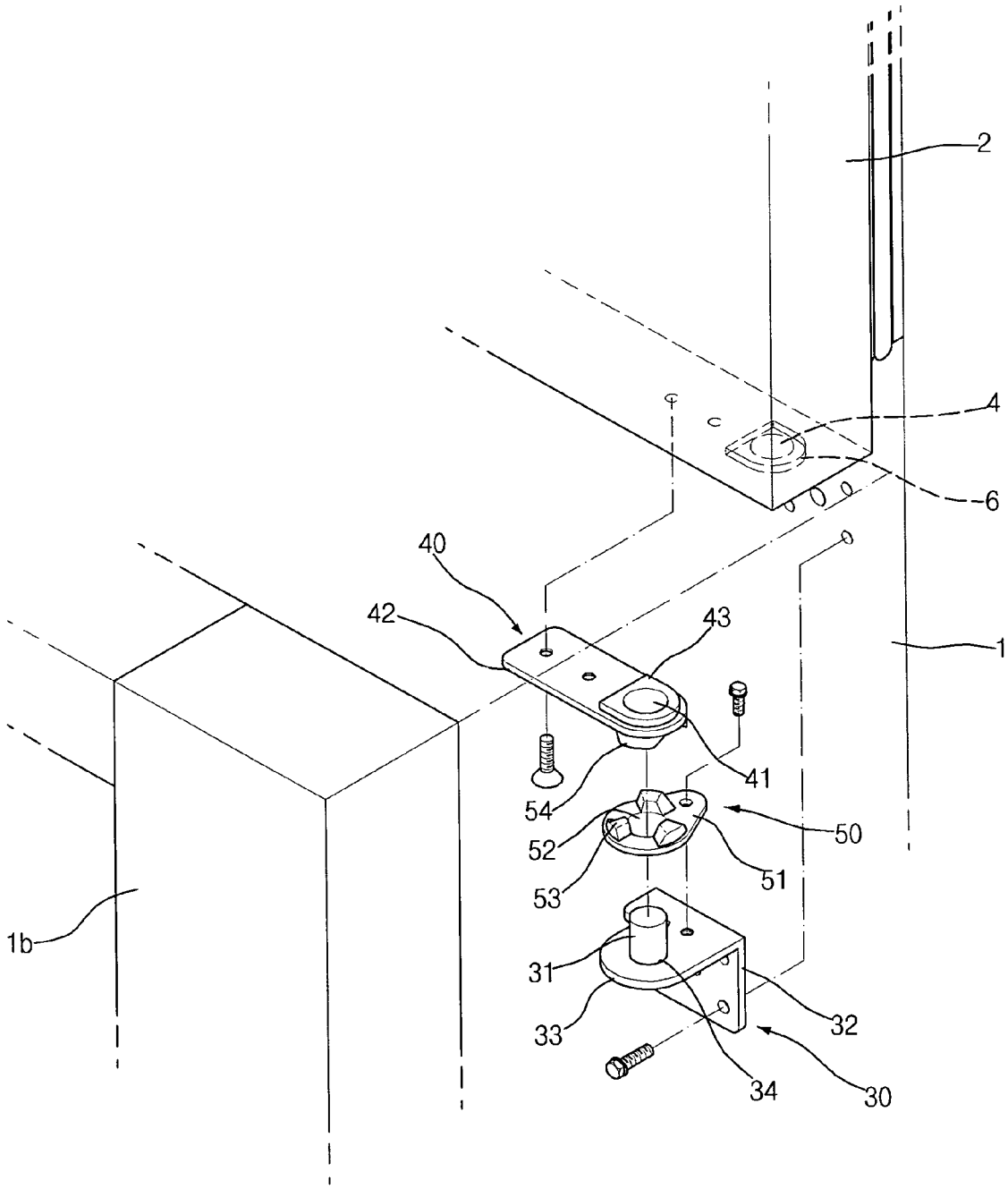
FIG. 4 is an exploded perspective view illustrating the door hinge structure for a refrigerator in accordance with the present invention, in relation to the circle (B) shown in FIG. 1.
Figure 5:
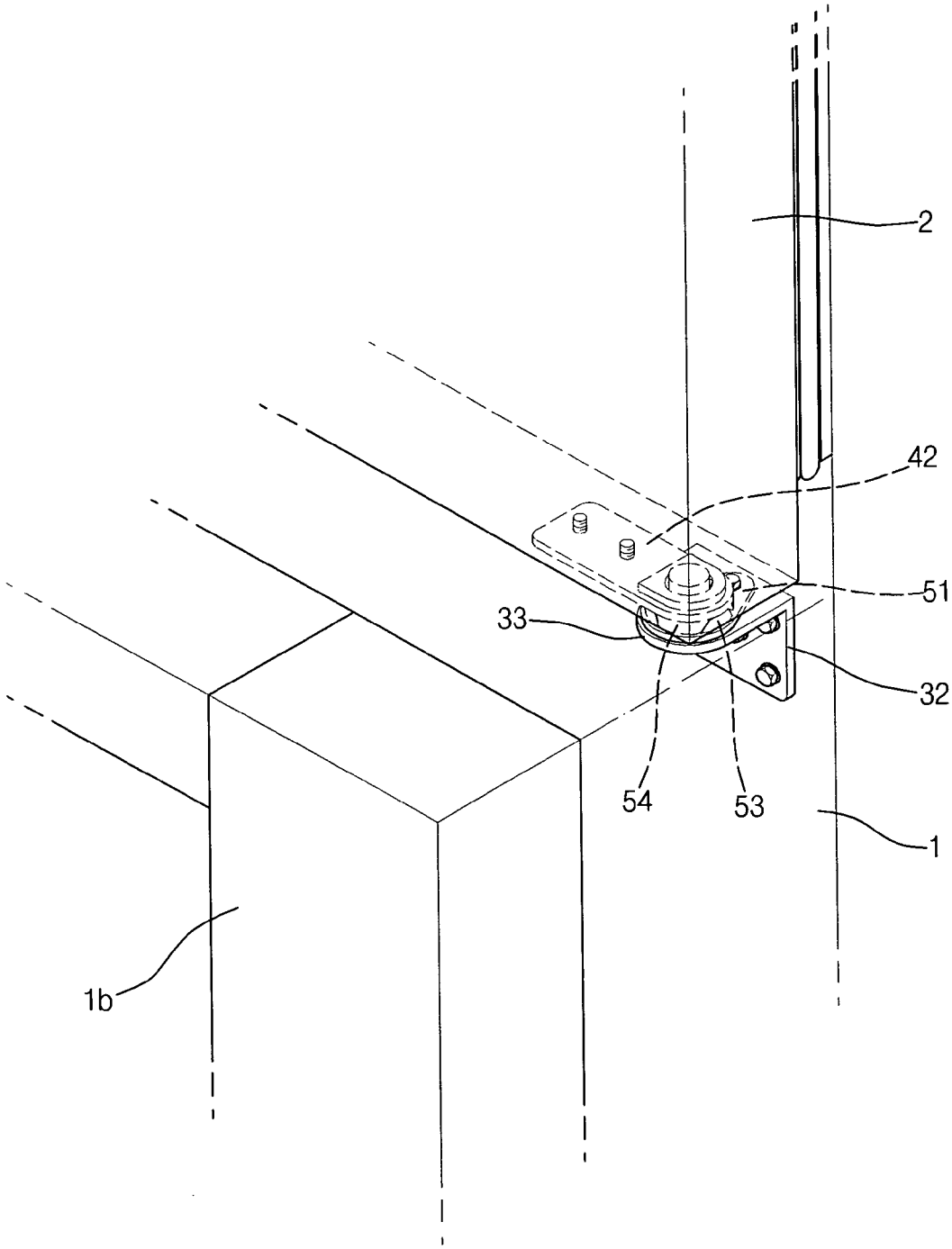
FIG. 5 is a perspective view illustrating an assembled state of the door hinge structure shown in FIG. 4.

FIG. 4 is an exploded perspective view illustrating the door hinge structure for a refrigerator in accordance with the present invention, in relation to the circle (B) shown in FIG. 1. FIG. 5 is a perspective view illustrating an assembled state of the door hinge structure shown in FIG. 4.

As shown in FIGS. 4 and 5, the door hinge structure for a refrigerator comprises: a lower fixture unit 30 screwed to the body 1 behind the lower cover 1*b* at a lower side of the door 2; a lower hinge unit 40 mounted on a lower surface of the door 2 so that it is hingedly coupled with the lower fixture unit 30; and a stopper member 50 interposed between the lower fixture unit 30 and the lower hinge unit 40.

The lower fixture unit 30, in turn, includes: a lower bracket 32 screwed to the body 1; a lower arm 33 horizontally extending from an upper end of the lower bracket 32 at right angles thereto; a lower opening 34 perforated in the lower arm 33; and a lower hinge pin 31 fixedly inserted at its lower end in the lower opening 34.

In the lower fixture unit 30, since the lower bracket 32 thereof is screwed to a predetermined lower position of the front surface of the body 1 and the lower hinge pin 31 thereof is inserted in the lower hinge unit 40, it serves to pivotably fix the lower hinge unit 40 relative to the body 1.

The lower hinge unit 40 comprises: a lower mount 42 mounted on the lower surface of the door 2; a through opening 41 perforated in the lower mount 42 so as to be vertically aligned with a bottom aperture 4 of the door 2 for the insertion of the lower hinge pin 31; and a plate 43 provided at an upper surface of the lower mount 23 to surround the through opening 41. The plate 43 is insertable in a groove 5 internally formed around the bottom aperture 4 of the door 2.

In a state wherein the lower mount 42 thereof is screwed to the lower surface of the door 2, and the lower hinge pin 31 of the lower fixture unit 30 is inserted through the through opening 41 thereof, the lower hinge unit 40 serves to pivotably fix the door 2 relative to the body 1.

The plate 43 provided at the upper surface of the lower mount 42 is engaged in the lower groove 6 formed along the inner periphery of the bottom aperture 4 of the door 2. This has an effect of increasing a fixing force of the lower mount 42 even while increasing ease in installation thereof.

The stopper member 50 comprises: a mount 51 which is mounted on an upper surface of the lower arm 33 of the lower fixture unit 30, and has a central opening 52 for the insertion of the lower hinge pin 31; a plurality of rounded upwardly-raised lower stops 53 circularly aligned on an upper surface of the mount 51; and a plurality of rounded downwardly-raised upper stops 54 circularly aligned around the through opening 41 perforated in the lower mount 42 in an engagable manner with the upwardly-raised lower stops 53.

When the door 2 is opened, the upwardly-raised lower stops 53 pass over the downwardly-raised upper stops 54 or are engaged therewith, thereby allowing the door 2 to be continuously kept in an open position in an easy manner after being manually opened by a predetermined angle.

Figure 6:
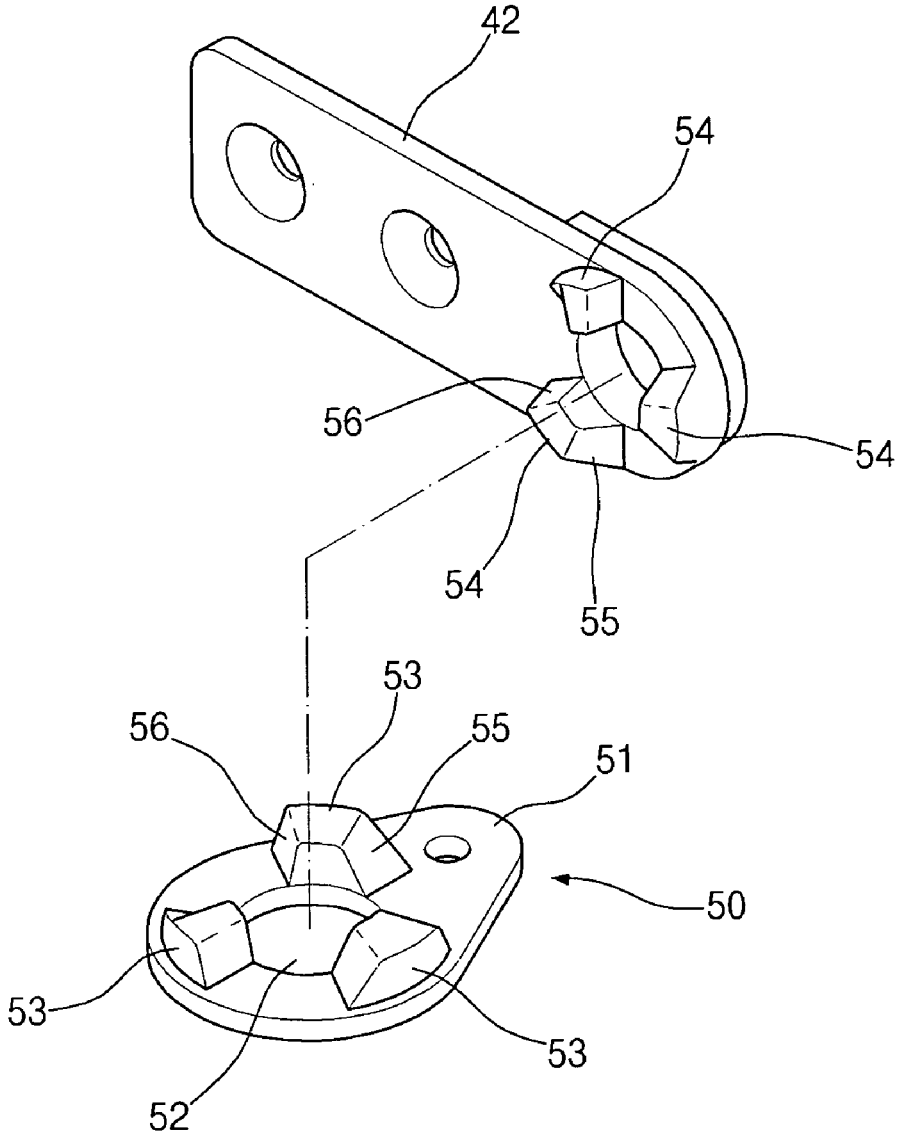
FIG. 6 is a perspective view illustrating a stopper member and a lower mount in accordance with the present invention.

FIG. 6 is a perspective view illustrating the stopper member 50 and the lower mount 42 of the present invention.

As shown in FIG. 6, the plurality of upwardly-raised lower stops 53 of the stopper member 50 are arranged on the mount 51 having the central opening 52, so that they are engaged with the plurality of downwardly-raised upper stops 54 arranged around the through opening 41 of the lower mount 42.

Each of the upwardly-raised lower stops 53 and the downwardly-raised upper stops 54 has a gentle sloped surface 55 at one lateral side thereof, and a steep sloped surface 56 at the other lateral side thereof. All of the gentle sloped surfaces 55 of the lower and upper stops 53 and 54 are inclined in a forward direction, namely a door opening direction, and all of the steep sloped surfaces 56 of the lower and upper stops 53 and 54 are inclined in a reverse direction, namely a door closing direction.

The gentle sloped surfaces 55 serve to allow the upwardly-raised lower stops 53 to smoothly pass over the downwardly-raised upper stops 54 as the door 2 is swung open. On the other hand, the steep sloped surfaces 56 serve to allow the upwardly-raised lower stops 53 to engage with the downwardly-raised upper stops 54 after the door 2 is opened by a predetermined angle, thereby immobilizing the door 2 so as not to be swung back in a door closing direction. The steep sloped surfaces 56, furthermore, enable the upwardly-raised lower stops 53 to smoothly pass over the downwardly-raised upper stops 54 therealong when the door 2 is gently pushed toward the closing position.

Preferably, there are provided three upwardly-raised lower stops 53 and three downwardly-raised upper stops 54, which are, respectively, circularly aligned by a spacing angle of 120 degrees. In this case, the door 2 can be stopped after being opened to an angle of 120 degrees.

More preferably, there are provided four upwardly-raised lower stops 53 and four downwardly-raised upper stops 54, which are, respectively, circularly aligned by a spacing angle of 90 degrees, thereby allowing the door 2 to be stopped after being opened to an angle of 90 degrees or 180 degrees.

Figure 7:
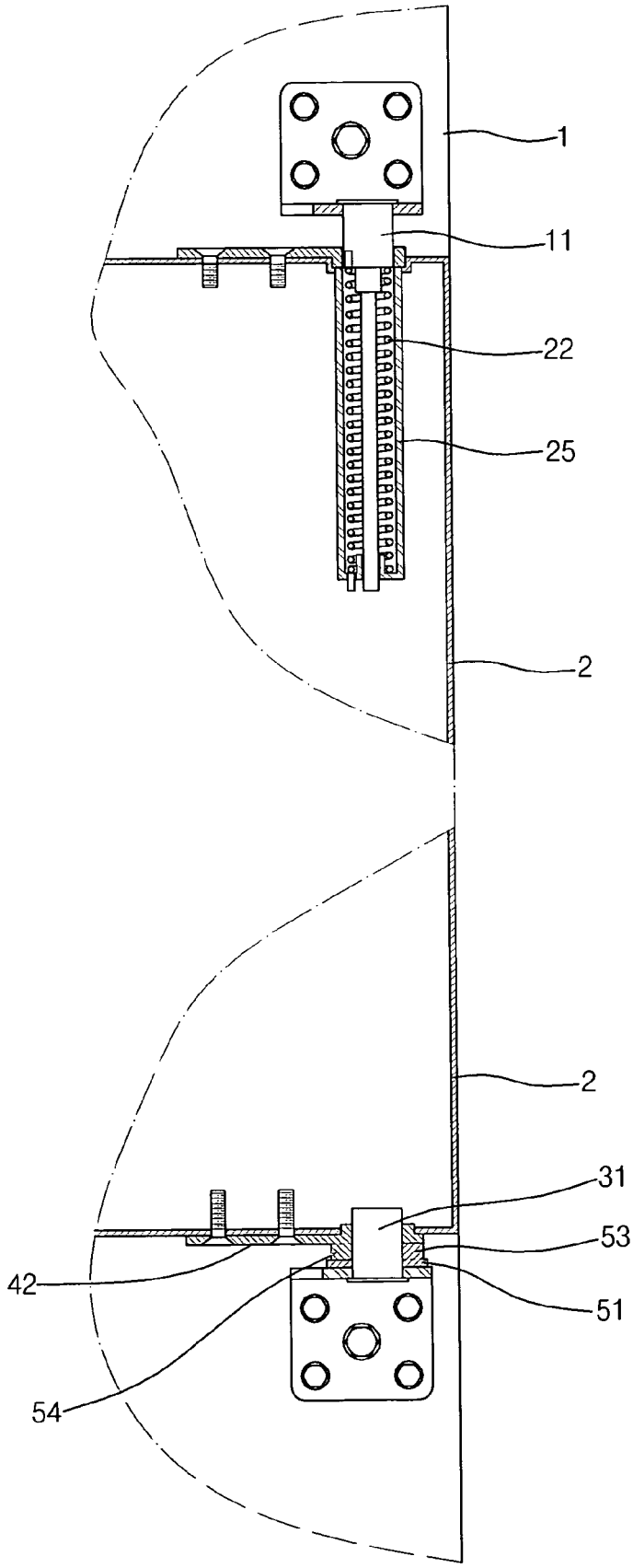
FIG. 7 is a vertical cross-sectional view illustrating important portions of the door hinge structure in accordance with the present invention, shown in a closed state of a refrigerator door.
Figure 8:
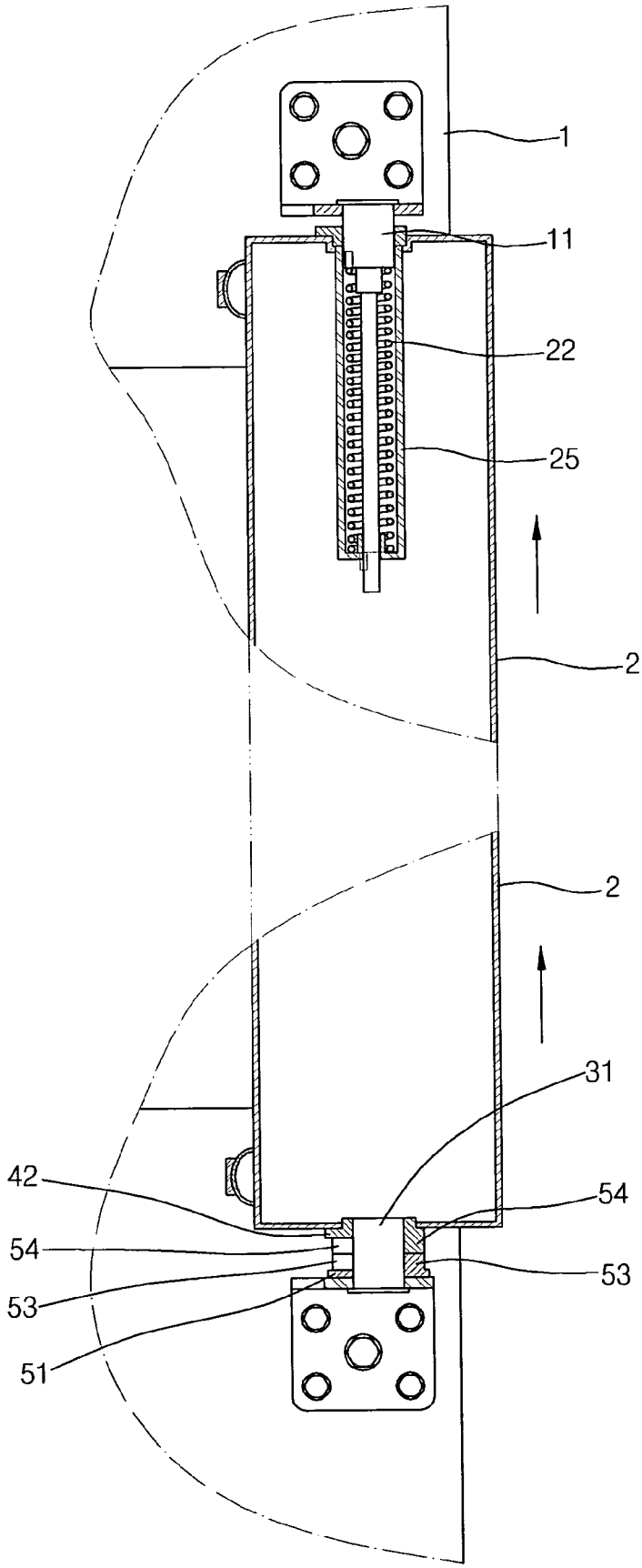
FIG. 8 is a vertical cross-sectional view illustrating important portions of the door hinge structure in accordance with the present invention, shown in an open state of the refrigerator door.
Figure 9:
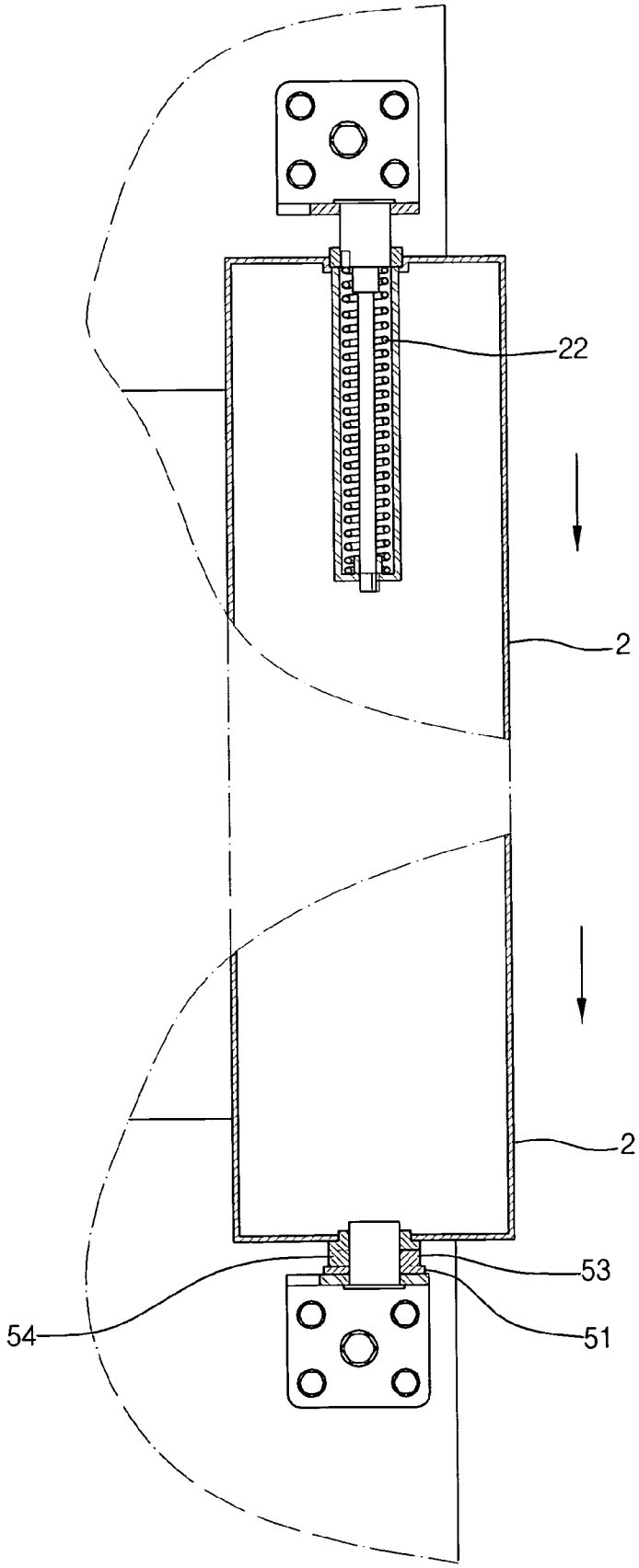
FIG. 9 is a vertical cross-sectional view illustrating important portions of the door hinge structure in accordance with the present invention, shown in a state wherein the door is swung open and is immobilized.
Figure 10:
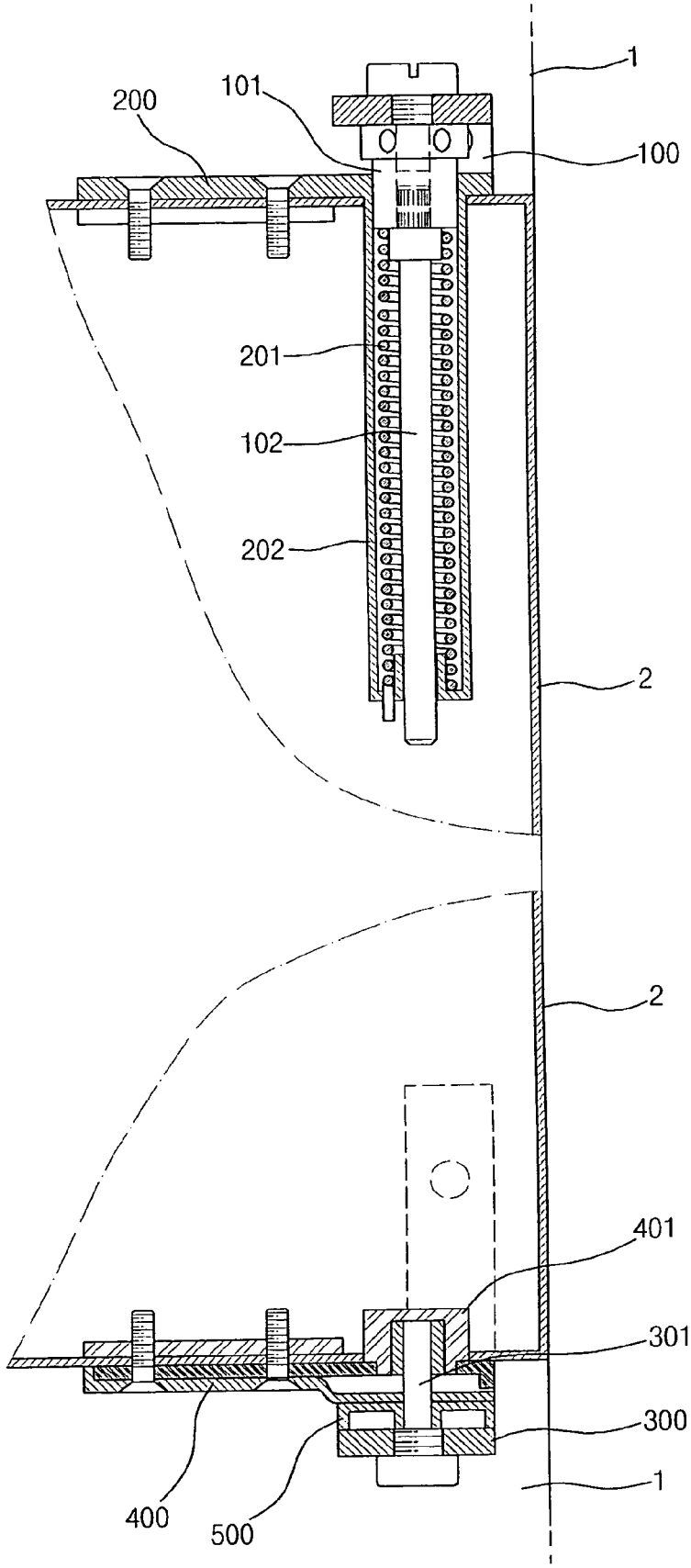
FIG. 10 is a vertical cross-sectional view illustrating important portions of a door hinge structure for a refrigerator of the prior art.

FIG. 7 is a vertical cross-sectional view illustrating important portions of the door hinge structure in accordance with the present invention, in a closed state of a refrigerator door. FIG. 8 is a vertical cross-sectional view illustrating important portions of the door hinge structure in accordance with the present invention, in an open state of the door. FIG. 9 is a vertical cross-sectional view illustrating important portions of the door hinge structure in accordance with the present invention, in a state wherein the door is opened and is immobilized.

As shown in FIGS. 7 and 8, if the door 2 is manually swung open from the closing position, the downwardly-raised upper stops 54 of the lower mount 42, which were engaged with the upwardly-raised lower stops 53 of the mount 51, ascend along the lower stops 53 so that upper surfaces of the lower stops 53 come into contact with lower surfaces of the upper stops 54. As a result, the door 2 is raised along the lower hinge pin 31.

According to the rising of the door 2, subsequently, the insertion column 25 is raised along the upper hinge pin 11, and consequently the torsion spring 22 is circumferentially distorted and vertically compressed.

As shown in FIGS. 8 and 9, if the door 2 is further opened, the upper stops 54, which were in contact at their lower surfaces with the upper surfaces of the lower stops 53, descend from the lower stops 53, and are again engaged with the lower stops 53. Thereby, the torsion spring 22 is released from its vertically compressed state, and the door 2 is returned to its original lower position.

In this case, the door 2 can be immobilized after being opened by a predetermined angle as the lower and upper stops 53 and 54 are engaged with each other.

If the door 2 is gently pushed to move from such an open position toward the closing position, torsional tension of the torsion spring 22 will be released to allow the upper stops 54 to again pass over the lower stops 53, so that the door 2 can be smoothly moved to the closing position.

As apparent from the above description, such a door hinge structure for a refrigerator in accordance with the present invention can smoothly keep a refrigerator door open when food is placed into or taken out of the interior of the refrigerator, thereby enhancing convenience in use of the refrigerator.

Further, according to the present invention, the overall structure of refrigerator door hinges is simplified and thus can secure easy installation thereof.

Furthermore, the present invention has an effect of allowing a refrigerator door to move from the open position and to close itself easily even by a gentle push thereon.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A door hinge structure for a refrigerator, the door hinge structure comprising:

an upper fixture unit screwed to a predetermined front upper portion of a refrigerator body, and having an upper hinge pin to be inserted in a top aperture formed at an upper surface of a refrigerator door;

an upper hinge unit mounted on the upper surface of the door, and having a through opening for allowing a distal end of the upper hinge pin to be slidably inserted therethrough, the upper hinge unit being coupled with the upper fixture unit, the upper hinge unit having a torsion spring, the upper hinge unit and the upper fixture unit being vertically spaced apart from each other;

a lower fixture unit screwed to a predetermined front lower portion of the body, and having a lower hinge pin to be inserted in a bottom aperture formed at a lower surface of the door;

a lower hinge unit mounted on the lower surface of the door, and having a through opening for the insertion of the lower hinge pin; and a stopper member interposed between the lower fixture unit and the lower hinge unit and adapted to stop pivotal movement between a closed position and an open position of the door;

wherein the upper hinge unit includes:

an upper mount mounted on the upper surface of the door, and having the through-opening;

a plate provided at a lower surface of the upper mount so as to surround the through-opening, the plate being insertable in an upper groove formed along an inner periphery of the top aperture; and a hollow insertion column attached to a lower surface of the plate to be vertically aligned with the through opening, into which a torsion spring is inserted.

2. The structure as set forth in claim 1, wherein the stopper member includes:

a mount mounted on an upper surface of the lower fixture unit, and having a central opening for the insertion of the lower hinge pin;

at least two rounded upwardly-raised lower stops circularly aligned on an upper surface of the mount; and at least two rounded downwardly-raised upper stops circularly aligned around the through opening of the lower hinge unit in an engagable manner with the upwardly-raised lower stops.

3. The structure as set forth in claim 2, wherein the upper fixture unit includes:

an upper bracket screwed to the predetermined front upper portion of the body;

an upper arm horizontally extending from a lower end of the upper bracket at right angles thereto; and an upper opening perforated in the upper arm for allowing the upper hinge pin to be fixedly inserted therein.

4. The structure as set forth in claim 2, wherein the lower fixture unit includes:

a lower bracket screwed to the predetermined front lower portion of the body;

a lower arm horizontally extending from an upper end of the lower bracket at right angles thereto; and a lower opening perforated in the lower arm for allowing the lower hinge pin to be fixedly inserted therein.

5. The structure as set forth in claim 2, wherein the lower hinge unit includes:

a lower mount mounted on the lower surface of the door, and having the through opening; and a plate provided at an upper surface of the lower mount to surround the through opening, the plate being insertable in a lower groove formed along an inner periphery of the bottom aperture.

6. The structure as set forth in claim 2, wherein each of the upwardly-raised lower stops and the downwardly-raised upper stops includes:

a gentle sloped surface at one lateral side thereof so as to be inclined in a door opening direction; and a steep sloped surface at the other lateral side thereof so as to be inclined in a door closing direction.

7. The structure as set forth in claim 6, wherein the upper hinge pin is formed at a bottom wall thereof with a plurality of insertion holes for allowing an upper end of the torsion spring to be selectively inserted therein;

the hollow insertion column is formed at a bottom wall thereof with a plurality of insertion holes for allowing a lower end of the torsion spring to be selectively inserted therein;

at the center of the bottom wall of the upper hinge pin is vertically attached a support rod; and from the center of the bottom wall of the hollow insertion column a sliding tube extends upwardly for enabling slidable insertion of the support rod.

8. The structure as set forth in claim 1, wherein the upper fixture unit includes:

an upper bracket screwed to the predetermined front upper portion of the body;

an upper arm horizontally extending from a lower end of the upper bracket at right angles thereto; and an upper opening perforated in the upper arm for allowing the upper hinge pin to be fixedly inserted therein.

9. The structure as set forth in claim 8, wherein the lower fixture unit includes:

a lower bracket screwed to the predetermined front lower portion of the body;

a lower arm horizontally extending from an upper end of the lower bracket at right angles thereto; and a lower opening perforated in the lower arm for allowing the lower hinge pin to be fixedly inserted therein.

10. The structure as set forth in claim 8, wherein the lower hinge unit includes:

a lower mount mounted on the lower surface of the door, and having the through opening; and a plate provided at an upper surface of the lower mount to surround the through opening, the plate being insertable in a lower groove formed along an inner periphery of the bottom aperture.

11. The structure as set forth in claim 1, wherein the lower fixture unit includes:

a lower bracket screwed to the predetermined front lower portion of the body;

a lower arm horizontally extending from an upper end of the lower bracket at right angles thereto; and a lower opening perforated in the lower arm for allowing the lower hinge pin to be fixedly inserted therein.

12. The structure as set forth in claim 11, wherein the lower hinge unit includes:

a lower mount mounted on the lower surface of the door, and having the through opening; and a plate provided at an upper surface of the lower mount to surround the through opening, the plate being insertable in a lower groove formed along an inner periphery of the bottom aperture.

13. The structure as set forth in claim 1, wherein the lower hinge unit includes:

a lower mount mounted on the lower surface of the door, and having the through opening; and a plate provided at an upper surface of the lower mount to surround the through opening, the plate being insertable in a lower groove formed along an inner periphery of the bottom aperture.

* * * * *